United States Patent [19]

Golias

[11] Patent Number: 4,925,065

[45] **Date of Patent: * May 15, 1990**

[54] DISPENSING APPARATUS

[75] Inventor: Tipton L. Golias, Beaumont, Tex.

[73] Assignee: Helena Laboratories Corporation, Beaumont, Tex.

[ * ] Notice: The portion of the term of this patent subsequent to Mar. 14, 2006 has been disclaimed.

[21] Appl. No.: 89,275

[22] Filed: Aug. 25, 1987

Related U.S. Application Data

[63] Continuation-in-part of Ser. No. 266, Jan. 2, 1987, Pat. No. 4,811,866.

[51] Int. Cl.[5] ..... B67D 5/58

[52] U.S. Cl. ..... 222/189; 222/206; 222/420

[58] Field of Search ..... 222/189, 206, 214, 215, 222/420, 209, 571

[56] References Cited

U.S. PATENT DOCUMENTS

| | | | |
|---|---|---|---|
| 2,107,167 | 2/1938 | Sierad | 222/420 |
| 2,811,283 | 10/1957 | Bowen | 222/215 |
| 3,482,739 | 12/1969 | Laas | 222/182 |
| 3,972,812 | 8/1976 | Gresl, Jr. | 210/77 |
| 4,118,195 | 10/1978 | Beach | 222/215 |
| 4,526,490 | 7/1985 | Welsh | 222/215 |

FOREIGN PATENT DOCUMENTS

| | | | |
|---|---|---|---|
| 812289 | 6/1947 | Fed. Rep. of Germany | 222/189 |
| 2355057 | 7/1975 | Fed. Rep. of Germany | 222/420 |
| 2406576 | 8/1975 | Fed. Rep. of Germany . | |
| 1278307 | 10/1961 | France . | |
| 1333865 | 6/1962 | France | 222/420 |
| 1568155 | 4/1969 | France . | |

*Primary Examiner*—Joseph J. Rolla
*Assistant Examiner*—Kenneth Noland
*Attorney, Agent, or Firm*—Spencer & Frank

[57] ABSTRACT

Apparatus for dispensing a liquid is adapted to be attached to a container such as a test tube. The apparatus includes a hollow, resilient, flexible dispenser having a bore therethrough. One end of the dispenser is attached to the test tube, and the opposite end of the dispenser includes a nozzle apparatus having external and internal nozzle portions and a reverse-taper bore therethrough, i.e., a bore having a diameter which decreases from the external nozzle portion to the internal nozzle portion, the reverse-taper bore being in communication with the interior of the hollow, resilient dispenser.

9 Claims, 1 Drawing Sheet

DISPENSING APPARATUS

CROSS-REFERENCE TO RELATED APPLICATION

This is a continuation-in-part of my copending application, Ser. No. 000,266, filed Jan. 2, 1987 now U.S. Pat. No. 4,811,866, issued Mar. 14, 1989, for "Method and Apparatus For Dispensing Liquids."

TECHNICAL FIELD

The present invention relates generally to dispensing methods and apparatus and more specifically to an improved method and apparatus for separating, filtering and dispensing liquids such as blood serum, saline-washed red blood cells, and other biological fluids.

BACKGROUND OF THE INVENTION

The separation and analysis of chemical substances provides valuable quantitative and qualitative data for use by researchers and health care providers. Many assaying techniques have been developed which utilize sensitive chemical and instrument tests to detect the presence and amounts of normal and abnormal components of biological fluids. For example, the analysis of blood samples yields information which is critical to the proper diagnosis and subsequent treatment of many illnesses. To perform such a blood test, a sample of blood is obtained and is then prepared for analysis and, of course, there are many different analytical procedures currently available. Preparation of the blood sample typically requires that the various sample components be separated from each other in order to obtain a more nearly homogenous specimen for testing and evaluation, such as isolating blood serum which is to be analyzed. The amount of serum protein, protein-bound iodine, sodium, triglycerides, salicylate, uric acid, and many other components may be determined through the separation of a blood sample and subsequent analysis. Hence, fast and accurate methods of sample preparation are highly desirable.

The need for conveniently and efficiently dispensing liquid, such as a biological fluid, from a test tube or the like is encountered many times a day by laboratory workers. The opening or mouth of the test tube must be large enough for the material to be initially placed into the test tube. However, this proves to be a hindrance in the dispensing of fluid from the test tube since, quite frequently, too much fluid is dispensed from the test tube as the test tube is inverted. Conventional dispensing techniques, such as decanting a liquid from a precipitate using a stirring rod, requires considerable manipulative skill and does not provide adequate control over the volume of decanted liquid to be dispensed. Providing a lip or a spout on a test tube or other container may help direct the flow of fluid somewhat, but meaningful volume control is still not attained and splashing typically occurs. The transfer of liquids from a test tube to a specimen test area is more accurately controlled with a pipette; however, pipettes must be routinely cleaned and, of course, the pipetting operation must be performed each time a sample is to be dispensed.

Particularly in the environment of preparation and dispensing of biological fluids, a simple and convenient method and apparatus are needed so that a fluid may be easily dispensed from a container, such as a test tube. The present invention provides such a method and apparatus, whereby virtually any liquid may be easily dispensed from a test tube without the use of the complicated pouring techniques and complex devices.

It has been heretofore suggested to provide a flexible dispenser on a container such as a bottle. This is illustrated, for example, in British Patent Specification No. 659,217, published Oct. 17, 1951, and French Patent No. 1,333,865 of June 24, 1963. Each of these documents discloses a flexible, squeezable dispenser to be attached to a container. In addition, British Patent Specification No. 521,237 of May 19, 1940 describes and illustrates a closure for bottles or containers which is not only removable, but which also includes an internal extension which may engage a cork to close and seal the container.

When a dispenser is attached to a test tube and the test tube is inverted so that liquid may be dispensed, the fluid in the test tube tends to flow toward the dispenser, and the inertia of the moving fluid within the test tube often causes the fluid in the test tube to be dispensed prematurely. This phenomenon is referred to as "spitting" or "jetting." It is one of the principal purposes of the present invention to provide an improved dispensing means which eliminates the problem of "jetting," thus providing substantially improved control over the amount of biological fluid to be dispensed.

SUMMARY OF THE INVENTION

In accordance with the present invention, there is provided an elongated, hollow, resilient dispensing means adapted to be engaged on the open end of a test tube or similar container. The hollow dispensing means is a resilient tube having a large opening at one end, where engagement is provided with the test tube, and a narrow nipple-like opening at the other end. A filter may be provided within the resilient tube such that any fluid passing through the tube also passes through the filter. At the nipple end, nozzle means, such as an external projection and an internal projection are each provided with a continuous bore therethrough, the bore being reverse-tapered in diameter. The bore is in communication with the hollow interior of the dispensing means to provide a continuous flow path from the test tube through the dispensing means and through the reverse-taper bore in the projections. The external and internal projections may be referred to as nozzles or nipples.

In the method of the present invention, the resilient dispensing means is attached to the mouth of a container, such as a test tube containing a liquid sample, so that the dispensing means is frictionally, sealingly engaged by the container wall in a concentric manner. The nipple end of the dispensing means extends beyond the open end of the container. The container and the attached dispensing means are inverted so that the liquid flows into the hollow dispensing means, but the nozzle means with the reverse-tapered bore therethrough prevent inadvertent dispensing of liquid and function to neutralize the effect of inertia of the moving fluid within the test tube.

If a filter is provided, the liquid flows through the filter to remove any unwanted components in the sample. By squeezing the sides of the resilient dispensing means, one or more drops of fluid may be accurately dispensed through the reverse-tapered bore in the nozzle means. A cap may be provided to protect the nozzle means against breakage during shipment and storage and also to prevent evaporation of the fluid from the container if the dispensing means remains on the test tube or other container for prolonged intervals.

BRIEF DESCRIPTION OF THE DRAWINGS

The foregoing objects and benefits of the present invention, together with other objects, advantages and benefits which may be attained by its use, will become more apparent upon reading the following detailed description of the invention taken in conjunction with the drawings.

In the drawings, wherein like reference numerals identify corresponding components.

DETAILED DESCRIPTION OF THE INVENTION

Figure 1:
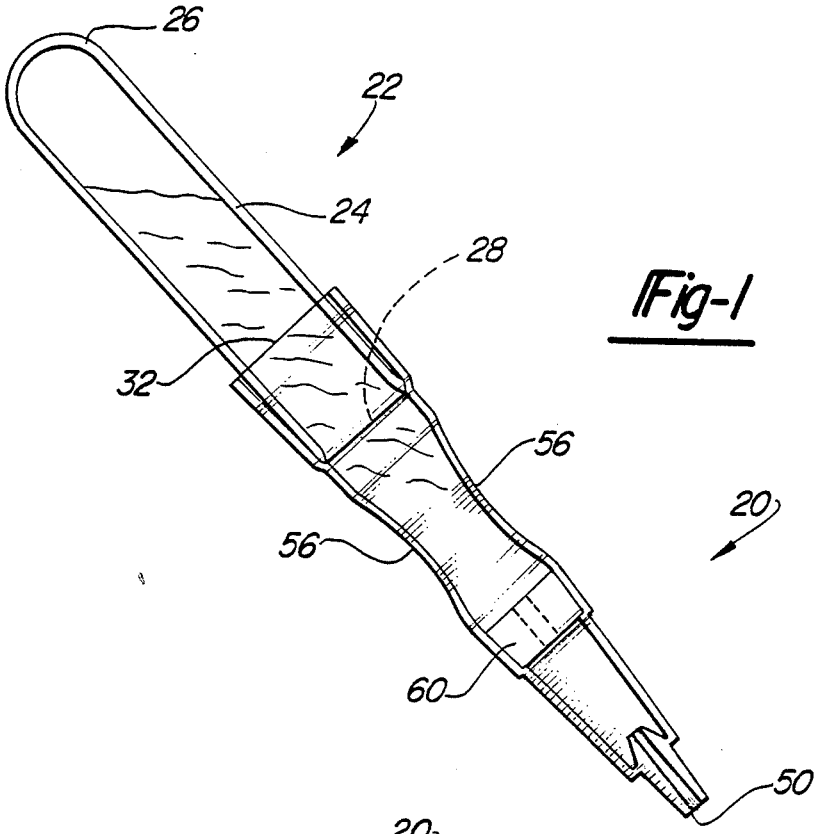
FIG. 1 is a side elevation view of the present invention including the dispensing means attached to a test tube with the sides of the resilient dispensing means compressed such that drops of liquid may be dispensed.
Figure 2:
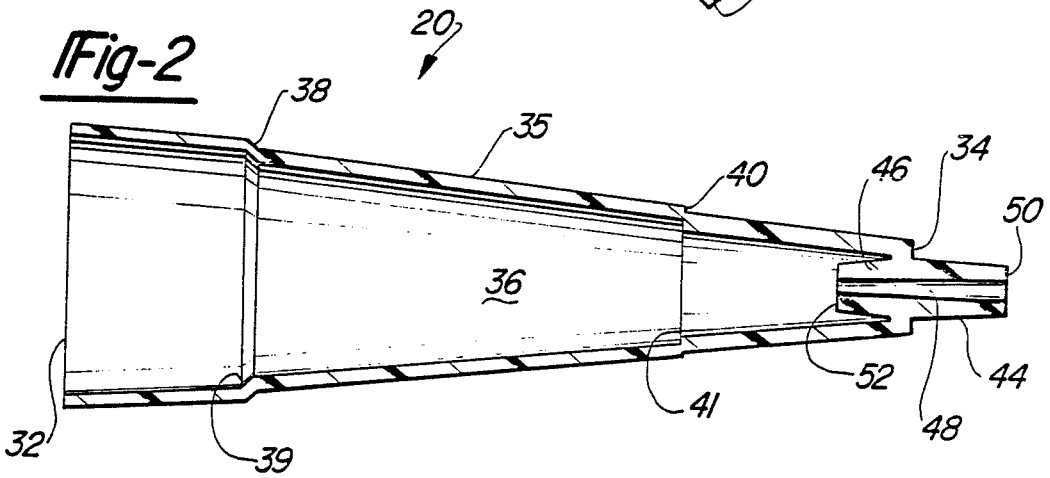
FIG. 2 is an enlarged sectional view of the dispensing means of the present invention.

Referring first to FIG. 1, dispensing means 20 is illustrated as being sealingly engaged with a container 22 such as a test tube. The test tube, as is conventional, is a hollow, elongated, cylindrical member of glass or plastic, having side walls 24, enclosed first end 26, which may be rounded or semi-spherical, and an open end or mouth 28.

The dispensing means 20 is an elongated flexible resilient member, preferably made of polyethylene, having a first end 32 and a second end 34. The dispensing means is a hollow, thin-walled member having side walls 35, and the diameter of the dispensing means decreases from the first end 32 to the second end 34. The interior of the dispensing means 20 may be identified as a fluid flow passage or chamber 36.

The dispensing means, and the internal chamber, are gradually reduced or tapered in diameter from the first end 32 to the second end 34. In addition to this gradual taper, there are a plurality of step-reductions in the diameter, each of which defines both an external step or shoulder and a corresponding internal seat.

By way of example, and not by way of limitation, a first shoulder 38 is provided about one-fifth of the distance from the first end 32 toward the second end 34. This shoulder provides an internal seat 39 for engagement with the mouth 28 of the test tube. Thus, if the dispensing means is force-fit onto the mouth of the test tube, the mouth of the test tube seats at the interior 39 of the first shoulder 38 and is frictionally retained therein.

A second shoulder 40 may be provided about two-thirds the distance from the front end 32 toward the second end 34. This second shoulder 40 defines, on the interior of the chamber 36, a second seat 41 where a filter may be retained.

Referring now to the second end 34 of the dispensing means, this second end 34 is frequently referred to as the nozzle end or nipple end of the dispensing means. The second end 34 of the dispensing means includes nozzle means such as a hollow external projection 44 and a hollow internal projection 46. The external and internal projections 44, 46, respectively, may be referred to as external and internal nipples, external and internal nozzles, or external and internal ejectors. A continuous bore 48 is provided from the outermost end 50 of the external projection 44 through the external projection, through the internal projection, and terminating at the innermost end 52 of the internal projection 46. The bore 48 is reverse-tapered in diameter relative to the taper or changing diameter of the dispensing means 20. That is to say, the diameter of the bore 48, at the first end 50, is greater than the diameter of the bore at the second end 52 of the nozzle means. Collectively, the external and internal nozzles with the reverse-tapered bore therethrough may be referred to as the nozzle means for the dispenser 20. In one embodiment for use on a test tube, the reverse-tapered bore decreases in diameter from 0.050 to 0.030 inches, whereas the bore in the dispensing means would decrease from about 0.67 to about 0.13 inches. These dimensions are, of course, for illustrative purposes only. The nozzle means may be formed as a separate part or integrally with the dispensing means 20.

With liquid in the test tube or container 22 and the dispensing means attached to the test tube such that the test tube mouth is in sealing engagement at the internal seat 39 of the shoulder 38, when the assembly is inverted to permit dispensing liquids, the nozzle means prevents the accidental dispensing of fluids through the bore 48. That is to say, the movement of fluid when the device is inverted causes an inertia which would tend to force liquid out through the dispensing means, but the configuration of the dispensing means, including the nozzle means, retards, resists and overcomes this inertia and prevents the accidental discharge of the liquid.

FIG. 1 illustrates the sides or walls 35 of the dispensing means 20 flexed inwardly or compressed as at 56 to provide for deliberate dispensing of fluid through the dispensing means. Thus, the repeated flexing or compressing of the walls 35 of the dispensing means causes fluid to be dispensed through the nozzle means.

Figure 3:
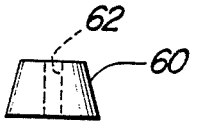
FIG. 3 is a side elevation view of a filter for use in the dispensing means of the present invention.

Referring next to FIG. 1 and FIG. 3, filter means 60 is illustrated. Filter means 60 is adapted to be inserted into the dispensing means and seat at the internal seat 41 at the shoulder 40 with the filter means 60 frictionally retained in place therein. Thus, the filter should be compressible and tapered slightly. Alternatively, an adhesive may be utilized on the exterior of the filter where the filter engages the interior wall 35 of the dispensing means, as long as care is taken such that the adhesive does not enter the filler bore 62, and thus the adhesive will not be dispensed through the dispensing means 20. Filter means 60, as generally illustrated in FIG. 3, is formed in side elevation as a tapered or truncated cone having a bore 62 therethrough. It should be understood that a filter per se is deemed to be a conventional product.

Figure 4:
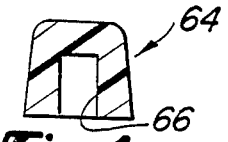
FIG. 4 is a sectional view of a cap which may be used on the dispensing means of the present invention.

FIG. 4 illustrates a cap 64 which may be utilized to cover the external nozzle 44 of the nozzle means. The cap 64, which may be formed of plastic, includes an internal tapered bore 66, extending partially therethrough so that the cap may be frictionally engaged on the external projection 44 to prevent damage to the external projection 44. In addition, should the dispensing means be positioned on the test tube for prolonged periods, the use of the cap 64 prevents evaporation of the fluid from the test tube or container 22.

The foregoing is a complete description of a preferred embodiment of the present invention. Many changes and modifications may be made without departing from the spirit and scope of the present invention. The invention, therefore, should be limited only by the following claims.

What is claimed is:

1. Apparatus for dispensing liquid from a container having at least one opening, comprising:

a flexible, resilient elongated dispensing means for preventing jetting, said dispensing means having first and second outermost ends and a longitudinal bore therethrough, said first outermost end adapted to be engaged with said container at said opening to form a substantially fluid tight seal, said dispensing means having longitudinally spaced apart first and second tapering fluid constriction means interconnected by a body portion, the diameter of said bore being smaller at said first tapering fluid constriction means than at said second tapering fluid constriction means, said first tapering fluid constriction means for receiving a filter therein, said body portion being inwardly flexible whereby upon alternately applying force to and removing force from said resilient dispensing means to flex the resilient dispensing means, liquid is pumped from the container through the bore of said dispensing means; and said dispensing means second outermost end including nozzle means for counteracting the inertia of liquid moving within said dispensing means to prevent accidental dispensing of liquid, said nozzle means having a bore therethrough in communication with the bore of said dispensing means, and including an external nozzle and an internal nozzle, said nozzle bore extending continuously through said external and internal nozzles.

2. The invention as defined in claim 1 wherein said nozzle bore decreases in diameter from said external nozzle to said internal nozzle.

3. The invention as defined in claim 1 wherein said dispensing means bore decreases in diameter from said dispensing means first outermost end toward said dispensing means second outermost end.

4. An apparatus as defined in claim 1, wherein said first tapering fluid constriction means further includes an internal seat for receiving a filter.

5. An apparatus as defined in claim 4, further comprising a filter means disposed in said dispensing means.

6. Apparatus for dispensing liquid from an essentially rigid test tube having at least one opening, comprising:

a flexible elongated dispensing means having first and second ends and a longitudinal bore therethrough, said first end adapted to be engaged with said test tube at said opening in a substantially fluid tight seal, said bore being tapered to decrease in diameter from said first end toward said second end; said dispensing means including a first tapering fluid constricting portion for receiving a filter therein, and a second tapering fluid constricting portion, said first and second tapering fluid constricting portions interconnected by a flexible body portion of said dispensing means; and nozzle means at said dispensing means second end, for counteracting the inertia of liquid moving through said apparatus for preventing accidental dispensing of liquid, said nozzle means haivng a bore therethrough, said nozzle means bore being tapered in a longitudinal direction opposite to that of said dispensing means bore;

said nozzle means bore and said dispensing means bore establishing a continuous fluid flow path;

whereby upon flexibly compressing said dispensing means, liquid flows from said test tube through said dispensing means bore and through said nozzle means bore.

7. An apparatus as defined in claim 6, wherein said dispensing means further includes an internal seat adapted for receiving a filter.

8. An apparatus as defined in claim 6, further comprising a filter means disposed in said dispensing means.

9. An apparatus as defined in claim 6 wherein said nozzle means includes an external nozzle and an internal nozzle.

* * * * *